US011035072B2

(12) United States Patent
Pollett et al.

(10) Patent No.: US 11,035,072 B2
(45) Date of Patent: Jun. 15, 2021

(54) WASHING MACHINE APPLIANCE AND NOZZLE ASSEMBLY

(71) Applicant: Haier US Appliance Solutions, Inc., Wilmington, DE (US)

(72) Inventors: James Quentin Pollett, Louisville, KY (US); Jerrod Aaron Kappler, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 752 days.

(21) Appl. No.: 15/898,715

(22) Filed: Feb. 19, 2018

(65) Prior Publication Data

US 2019/0257023 A1 Aug. 22, 2019

(51) Int. Cl.

| | |
|---|---|
| ***D06F 39/08*** | (2006.01) |
| ***D06F 39/04*** | (2006.01) |
| ***D06F 34/28*** | (2020.01) |

(52) U.S. Cl.

CPC ..... *D06F 39/088* (2013.01); *D06F 34/28* (2020.02); *D06F 39/045* (2013.01); *D06F 39/085* (2013.01); *D06F 39/087* (2013.01)

(58) Field of Classification Search

None

See application file for complete search history.

(56) References Cited

U.S. PATENT DOCUMENTS

| | | | |
|---|---|---|---|
| 1,681,322 | A | 8/1928 | Cave |
| 2,712,746 | A | 7/1955 | Bochan |
| 3,144,031 | A | 8/1964 | Long |
| 7,735,345 | B2 | 6/2010 | Wright et al. |
| 7,814,768 | B2 | 10/2010 | Vecchi et al. |
| 2005/0188729 | A1 | 9/2005 | Zsambeki et al. |

FOREIGN PATENT DOCUMENTS

| | | | |
|---|---|---|---|
| CN | 103820967 | A | 5/2014 |
| CN | 104711823 | A | 6/2015 |
| EP | 2933367 | A1 | 10/2015 |
| WO | WO2013169005 | A1 | 11/2013 |
| WO | WO2015133734 | A1 | 9/2015 |

*Primary Examiner* — Rita P Adhlakha

(74) *Attorney, Agent, or Firm* — Dority & Manning, P.A.

(57) ABSTRACT

A washing machine appliance, including methods of operation, is provided herein. The washing machine appliance may include a cabinet, a tub positioned within the cabinet, a wash basket, and a nozzle assembly. The nozzle assembly may be mounted within the cabinet and configured to provide wash fluid to the tub. The nozzle assembly may include an extendable nozzle, a valve assembly, a retractable fluid supply conduit, a supplemental heater, and a temperature sensor. The extendable nozzle may define a fluid path between a nozzle inlet and a nozzle outlet. The valve assembly may be configured to provide a flow of wash fluid to the extendable nozzle. The supplemental heater may be positioned in thermal communication with the flow of wash fluid between the valve assembly and the nozzle outlet. The temperature sensor may be positioned in thermal communication with the flow of wash fluid downstream from the valve assembly.

18 Claims, 9 Drawing Sheets

WASHING MACHINE APPLIANCE AND NOZZLE ASSEMBLY

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash or rinse articles within the wash chamber. More specifically, a predetermined volume of wash fluid is typically provided through a stationary nozzle positioned at the center of the back wall of the washing machine appliance. However, in certain situations, a user may wish to have greater control over the wash fluid dispensed into the tub. For instance, a user may wish to direct the flow of wash fluid onto a particular garment or within a specific region of the wash tub (e.g., to perform a pretreating operation, to saturate a particular article of clothing). However, this ability may be limited by the increased complexity and wiring required to relocate existing stationary nozzles. Moreover, difficulties may arise with providing water at a desired temperature. Under certain circumstances, a slug of relatively cold water may form over time within the washing machine appliance (or at any other location between a hot water source and a nozzle of the washing machine appliance). Even when relatively warm or hot wire is desired, the slug of cold water may be dispensed. The ability to adjust the amount of water or wash fluid and its dispensing location is a commercially desirable feature and increases the user's positive perception of the wash process generally.

Accordingly, a washing machine appliance that provides a user with more control over the dispensing of wash fluid is desirable. In particular, a nozzle assembly that enables the dispensing of water at a desired temperature while preventing or reducing the effects of a cold water slug would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub positioned within the cabinet, a wash basket, and a nozzle assembly. The wash basket may be rotatably mounted within the tub and may define a wash chamber for receiving articles for washing. The nozzle assembly may be mounted within the cabinet and configured to provide wash fluid to the tub. The nozzle assembly may include an extendable nozzle, a valve assembly, a retractable fluid supply conduit, a supplemental heater, and a temperature sensor. The extendable nozzle may be movable between a retracted position and an extended position. The extendable nozzle may define a fluid path extending in fluid communication between a nozzle inlet and a nozzle outlet. The valve assembly may be configured to provide a flow of wash fluid to the extendable nozzle. The retractable fluid supply conduit may extend in fluid communication between the valve assembly and the nozzle inlet extendable nozzle to direct the flow of wash fluid to the extendable nozzle. The supplemental heater may be positioned in thermal communication with the flow of wash fluid between the valve assembly and the nozzle outlet. The temperature sensor may be positioned in thermal communication with the flow of wash fluid downstream from the valve assembly to detect a temperature of the flow of wash fluid to the extendable nozzle.

In another exemplary aspect of the present disclosure, a washing machine appliance is provided. The washing machine appliance may include a cabinet, a tub positioned within the cabinet, a wash basket, and a nozzle assembly. The wash basket may be rotatably mounted within the tub and may define a wash chamber for receiving articles for washing. The nozzle assembly may be mounted within the cabinet and configured to provide wash fluid to the tub. The nozzle assembly may include an extendable nozzle, a valve assembly, a retractable fluid supply conduit, a supplemental heater, and a temperature sensor. The extendable nozzle may be movable between a retracted position and an extended position. The extendable nozzle may define a fluid path extending in fluid communication between a nozzle inlet and a nozzle outlet. The valve assembly may be configured to provide a flow of wash fluid to the extendable nozzle. The retractable fluid supply conduit may extend in fluid communication between the valve assembly and the nozzle inlet of the extendable nozzle to direct the flow of wash fluid to the extendable nozzle. The supplemental heater may be positioned in thermal communication with the flow of wash fluid between the valve assembly and the nozzle outlet. The temperature sensor may be positioned in thermal communication with the flow of wash fluid between the valve assembly and the supplemental heater to detect a temperature of the flow of wash fluid to the extendable nozzle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
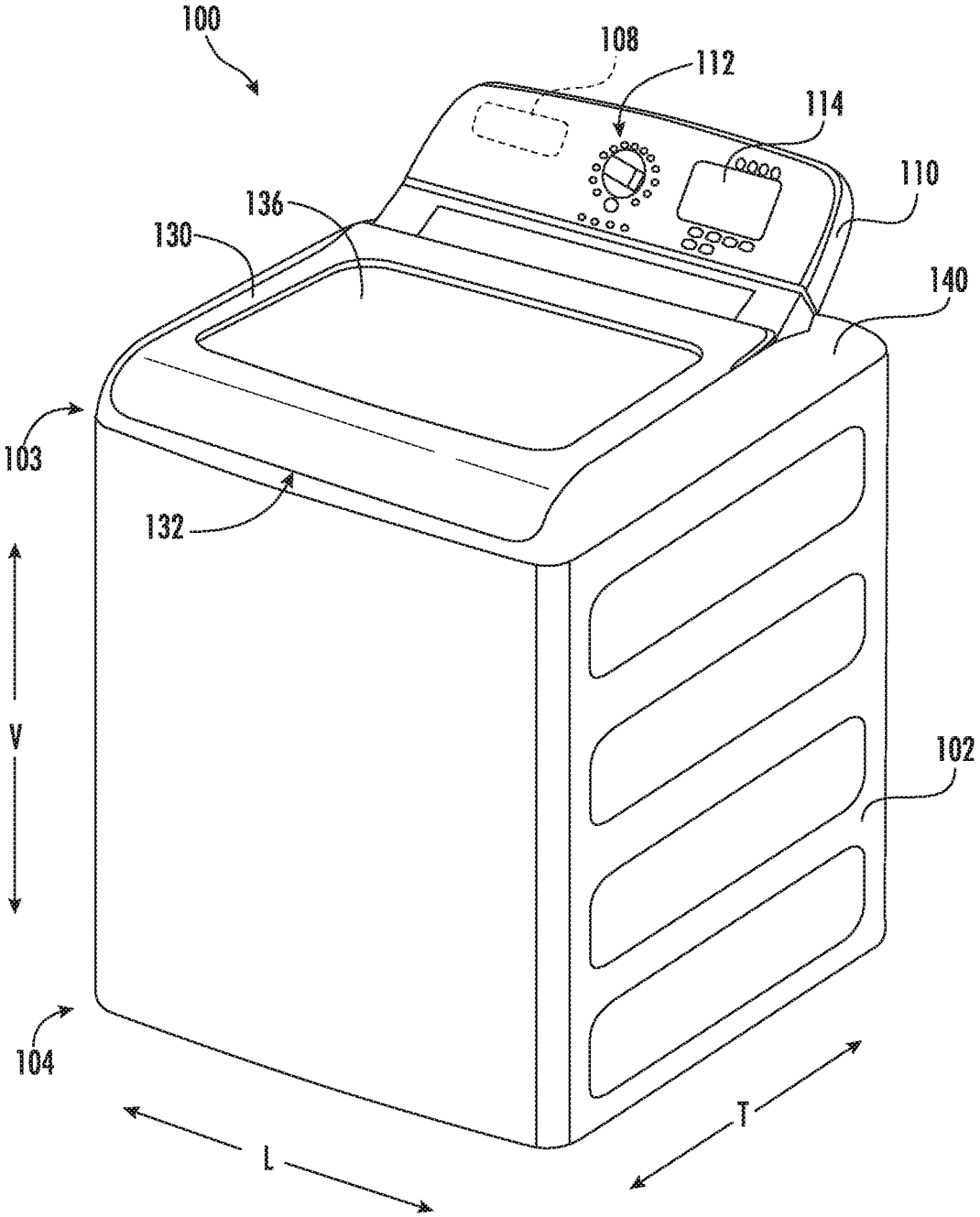
FIG. 1 provides a perspective view of a washing machine appliance according to an exemplary embodiment of the present disclosure with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
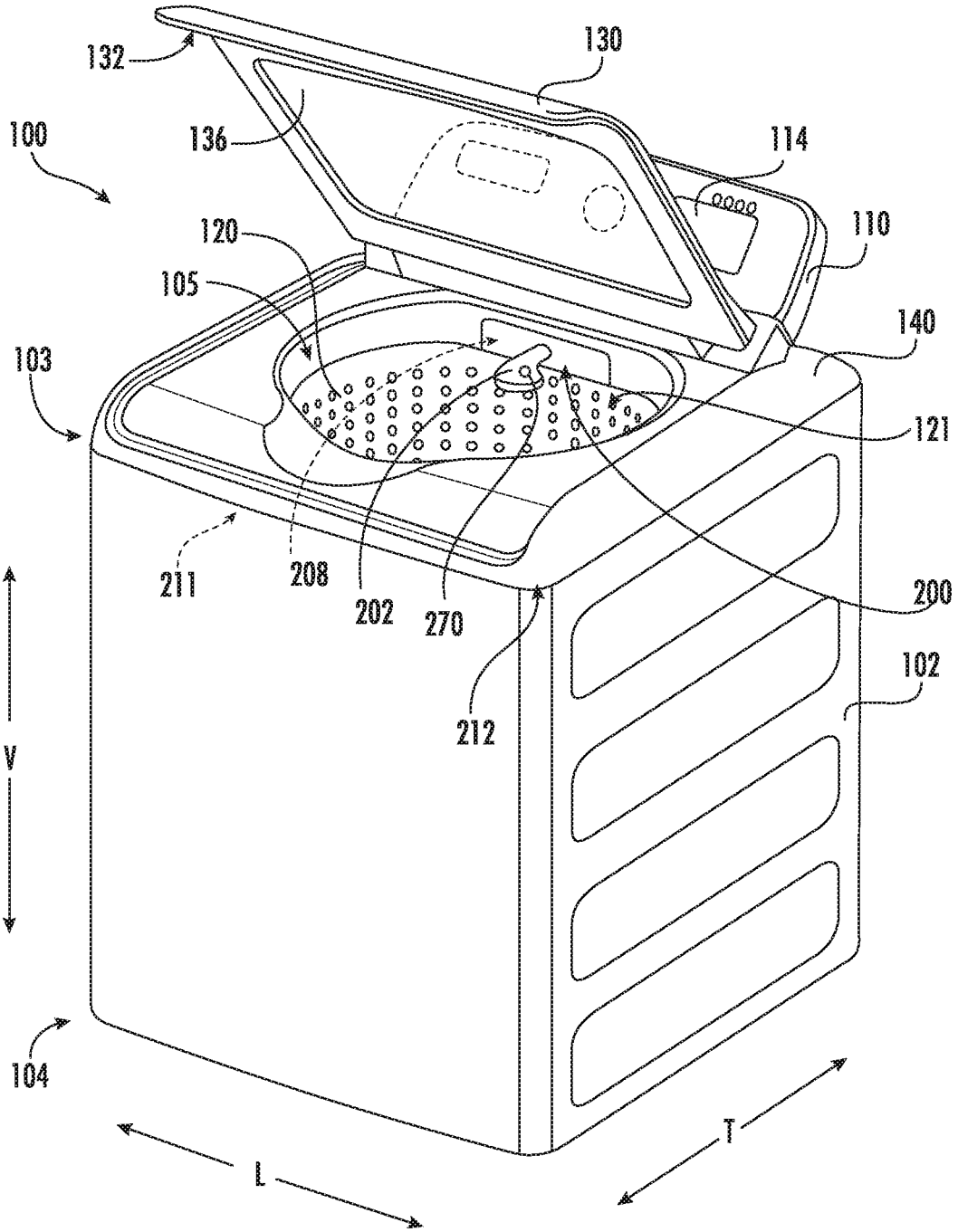
FIG. 2 provides a perspective view of the exemplary washing machine appliance of FIG. 1 with the door of the exemplary washing machine appliance shown in an open position.

Turning now to the figures, FIGS. 1 and 2 illustrate an exemplary washing machine appliance 100. In particular appliance 100 is shown as a vertical axis washing machine. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that washing machine appliance 100 is provided by way of example only. Other washing machine appliances having different configurations, different appearances, or different features may also be utilized with the present subject matter as well (e.g., horizontal axis washing machines). Moreover, aspects of the present subject matter may be used in any other consumer or commercial appliance where it is desirable to control the dispensing of water or another fluid.

As shown, washing machine appliance 100 has a cabinet 102 that extends between a top portion 103 and a bottom portion 104 along the vertical direction V. A wash basket 120 is rotatably mounted within cabinet 102. A motor (not shown) is in mechanical communication with wash basket 120 to selectively rotate wash basket 120 (e.g., during an agitation cycle or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. An agitator or impeller (not shown) may extend into wash basket 120 while remaining in mechanical communication with the motor. The impeller generally assists agitation of articles disposed within wash basket 120 and may rotate or oscillate during operation of washing machine appliance 100.

Cabinet 102 of washing machine appliance 100 generally includes a top panel 140. Top panel 140 defines an opening 105 (FIG. 2) that permits user access to wash basket 120 of wash tub 121. In some embodiments, door 130 is rotatably mounted to top panel 140 and permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In some embodiments, a window 136 in door 130 permits viewing of wash basket 120 when door 130 is in the closed position (e.g., during operation of washing machine appliance 100). Door 130 may also include a handle 132 that, for example, a user may pull or lift when opening and closing door 130. Further, although door 130 is illustrated as mounted to top panel 140, alternatively, door 130 may be mounted to another portion of cabinet 102, as well as any other suitable support.

In certain embodiments, a control panel 110 with at least one input selector 112 extends from top panel 140. Control panel 110 and input selector 112 collectively form a user interface input for operator selection of machine cycles and features. A display (e.g., electronic indicator display 114) of control panel 110 indicates selected features, operation mode, a countdown timer, or other items of interest to appliance users regarding operation.

Operation of washing machine appliance 100 is generally controlled by a controller or processing device 108 that is attached to cabinet 102 (e.g., at control panel 110) and operatively coupled (e.g., electrically coupled via one or more conductive signal lines, wirelessly coupled via one or more wireless communications bands, etc.) to portions of control panel 110 for user manipulation to select washing machine cycles and features. In response to user manipulation of control panel 110, controller 108 receives one or more signals (e.g., user-input signals) and operates the various components of washing machine appliance 100 to execute selected machine cycles and features.

Controller 108 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are generally loaded into wash basket 120 through opening 105, and a washing operation is initiated through operator manipulation of input selectors 112. Wash basket 120 is filled with a fluid, such as water and detergent or other fluid additives (e.g., via a nozzle assembly 200—described in detail below). One or more valves can be controlled by washing machine appliance 100 to provide for filling wash basket 120 to the appropriate level for the amount of articles being washed or rinsed. By way of example, for a washing cycle, once wash basket 120 is properly filled with fluid, the contents of wash basket 120 can be agitated (e.g., with an impeller as discussed above) for washing laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After laundry items or articles disposed in wash basket 120 are cleaned or washed, the user can remove the articles from wash basket 120 (e.g., by reaching into wash basket 120 through opening 105).

Referring now generally to FIGS. 2 through 7, nozzle assembly 200 will be described in more detail according to various exemplary embodiments of the present disclosure. Although the discussion below refers to nozzle assembly 200, one skilled in the art will appreciate that the features and configurations described may be used for other fluid supply assemblies in other washing machine appliances as well. For example, nozzle assembly 200 may be positioned in another location within cabinet 102, may have a different fluid supply conduit configuration, or may dispense any suitable wash fluid or fluids (e.g., water, detergent, other additives, or mixtures thereof). Other variations and modifications of the exemplary embodiments described below are possible, and such variations are contemplated as within the scope of the present disclosure.

As illustrated, nozzle assembly 200 generally includes an extendable nozzle 202 mounted to a retractable fluid supply conduit 204. More specifically, retractable fluid supply conduit 204 provides fluid communication between extendable nozzle 202 and a valve assembly 206. In addition, valve assembly 206 is coupled to a supply of water or wash fluid and selectively provides a flow of wash fluid to extendable nozzle 202 so that a user may selectively dispense the wash fluid within wash tub 121. For example, according to the illustrated exemplary embodiments of FIGS. 3 and 4, valve assembly 206 (and thus extendable nozzle 202) is directly coupled to a primary hot and cold water supply 207. In some such embodiments, retractable fluid supply conduit 204 is movable for positioning extendable nozzle 202 in a retracted position and an extended position, as described in more detail below. In this manner, extendable nozzle 202 may function as a primary fill nozzle in the retracted position and a spot treatment wand in the extended position.

Figure 8:
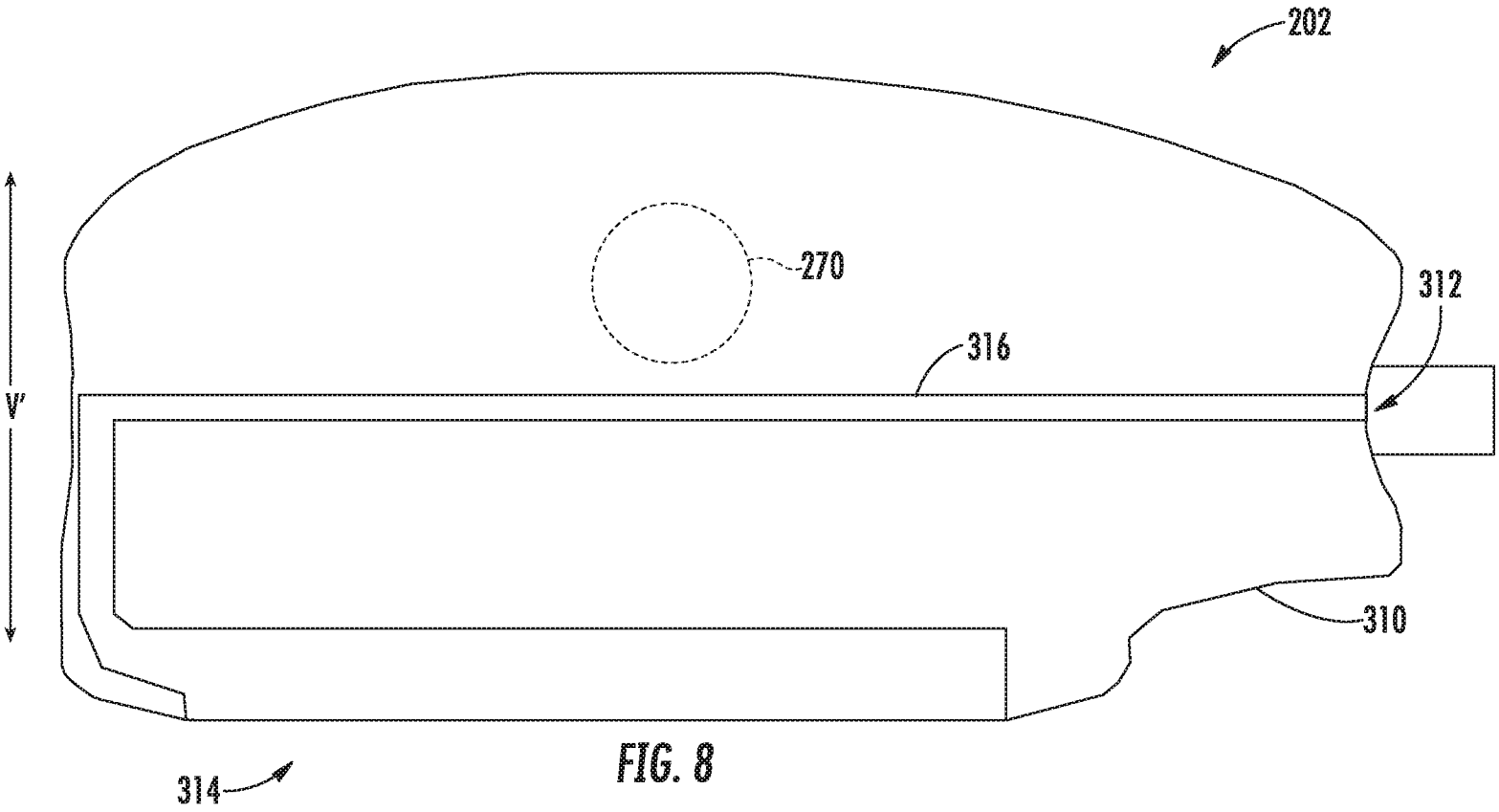
FIG. 8 provides a schematic side, cross-sectional view of an extendable nozzle according to exemplary embodiments of the present disclosure.

Turning briefly to FIG. 8, a schematic side, cross-sectional view of extendable nozzle 202 is provided according to exemplary embodiments. As shown, extendable nozzle 202 defines a vertical direction V', which is understood to be parallel to corresponding vertical direction V, shown in FIGS. 1 through 4, for example, when extendable nozzle 202 is in the retracted position. As shown, extendable nozzle 202 includes a nozzle body 310 defining a nozzle inlet 312 and a nozzle outlet 314. Nozzle inlet 312 is generally connected to fluid supply conduit 204 (FIG. 3) (e.g., in fluid communication with fluid supply conduit 204). Nozzle outlet 314 may include one or more spray ports or apertures and provides an output or exhaust for wash fluid from extendable nozzle 202. Within extendable nozzle 202 (e.g., within nozzle body 310), a fluid path 316 is defined between nozzle inlet 312 and nozzle outlet 314. For instance, one or more conduits or defined channels may be provided within extendable nozzle 202 to direct the flow of wash fluid. Thus, water or wash fluid entering extendable nozzle 202 at nozzle inlet 312 may flow along fluid path 316 before exiting extendable nozzle 202 (e.g., into the tub 121—FIG. 2) at nozzle outlet 314.

Returning to FIGS. 2 through 7, nozzle assembly 200 and its various components may be stored or mounted within cabinet 102 of washing machine appliance 100. In some embodiments, nozzle assembly 200 is mounted directly under top panel 140 along the vertical direction V such that nozzle assembly 200 is positioned between wash tub 121 and top panel 140. In this regard, washing machine appliance 100 may include a nozzle housing 208 defining a receiving chamber 209 within which fluid supply conduit 204 or extendable nozzle 202 are at least partially positioned. For example, when extendable nozzle 202 is in the retracted position, extendable nozzle 202 may be positioned within receiving chamber 209. In some such embodiments, extendable nozzle 202 remains visible to the user in the retracted position. However, when extendable nozzle 202 is pulled out toward the extended position, extendable nozzle 202 and at least a portion of fluid supply conduit 204 are positioned outside the receiving chamber 209 of nozzle housing 208 (e.g., above wash tub 121 along the vertical direction V). Notably, maintaining the position of extendable nozzle 202 above the wash tub 121 ensures that wash fluid from within the wash tub 121 cannot be drawn back through extendable nozzle 202 (e.g., into the water supply or leaked elsewhere within washing machine appliance 100).

Although the positioning and movement of nozzle assembly 200 is described herein according to exemplary embodiments, it should be appreciated that variations and modifications to the operation of nozzle assembly 200 may be made while remaining within the scope of the present disclosure. For example, FIG. 2 illustrates nozzle housing 208 and extendable nozzle 202 as being positioned along a back wall 210 and at a center of cabinet 102 along the transverse direction T. By contrast, according to the exemplary embodiments of FIGS. 6 and 7, nozzle housing 208 and extendable nozzle 202 are illustrated as being positioned along a front wall 211 of cabinet 102 at a corner 212 or lateral side along the lateral direction L. However, either embodiment may be positioned at any other suitable location or locations within washing machine appliance 100.

Figure 3:
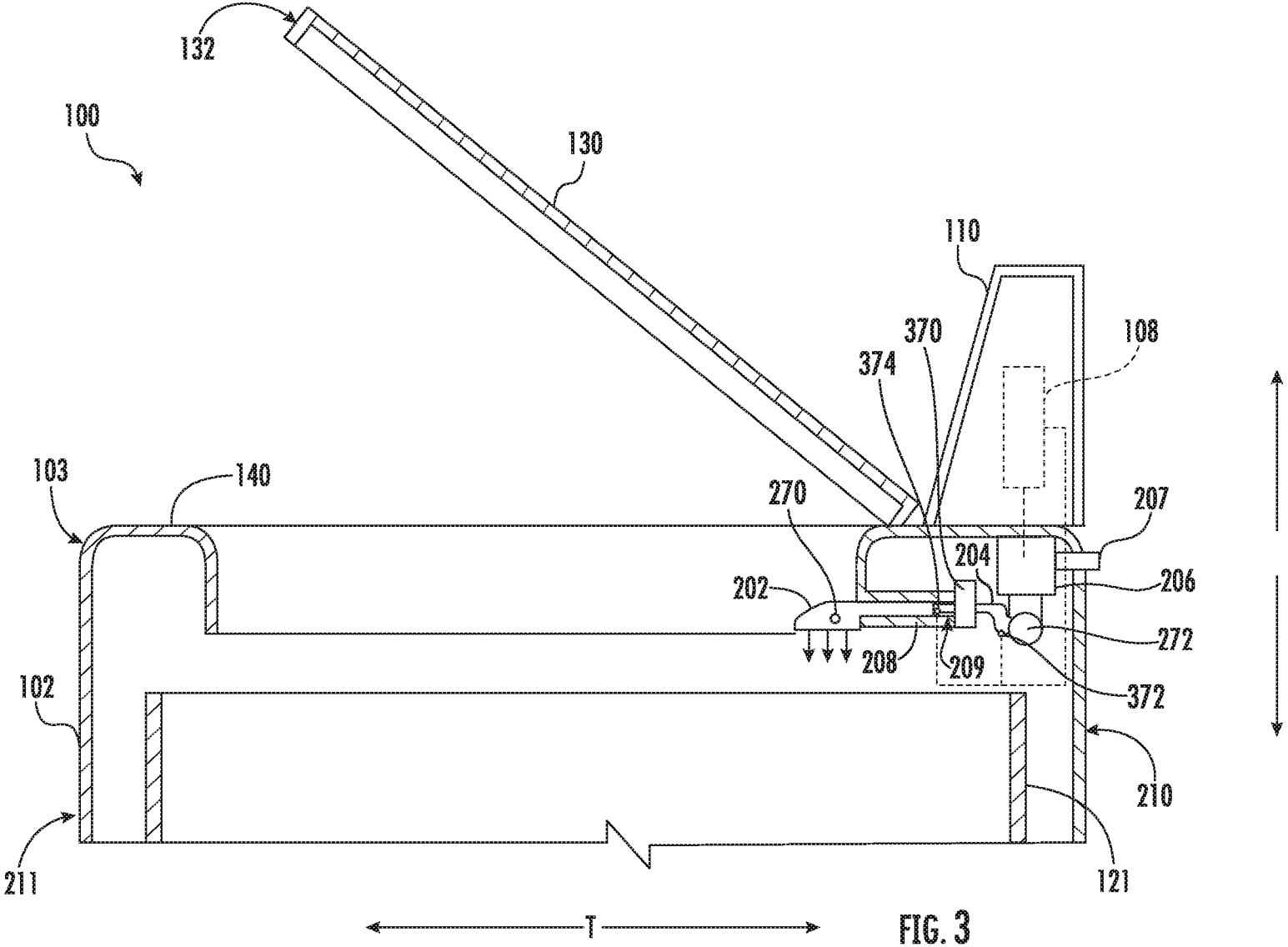
FIG. 3 provides a schematic side, cross-sectional view of a nozzle assembly of the exemplary washing machine appliance of FIG. 1 shown in a retracted position according to an exemplary embodiment of the present disclosure.
Figure 4:
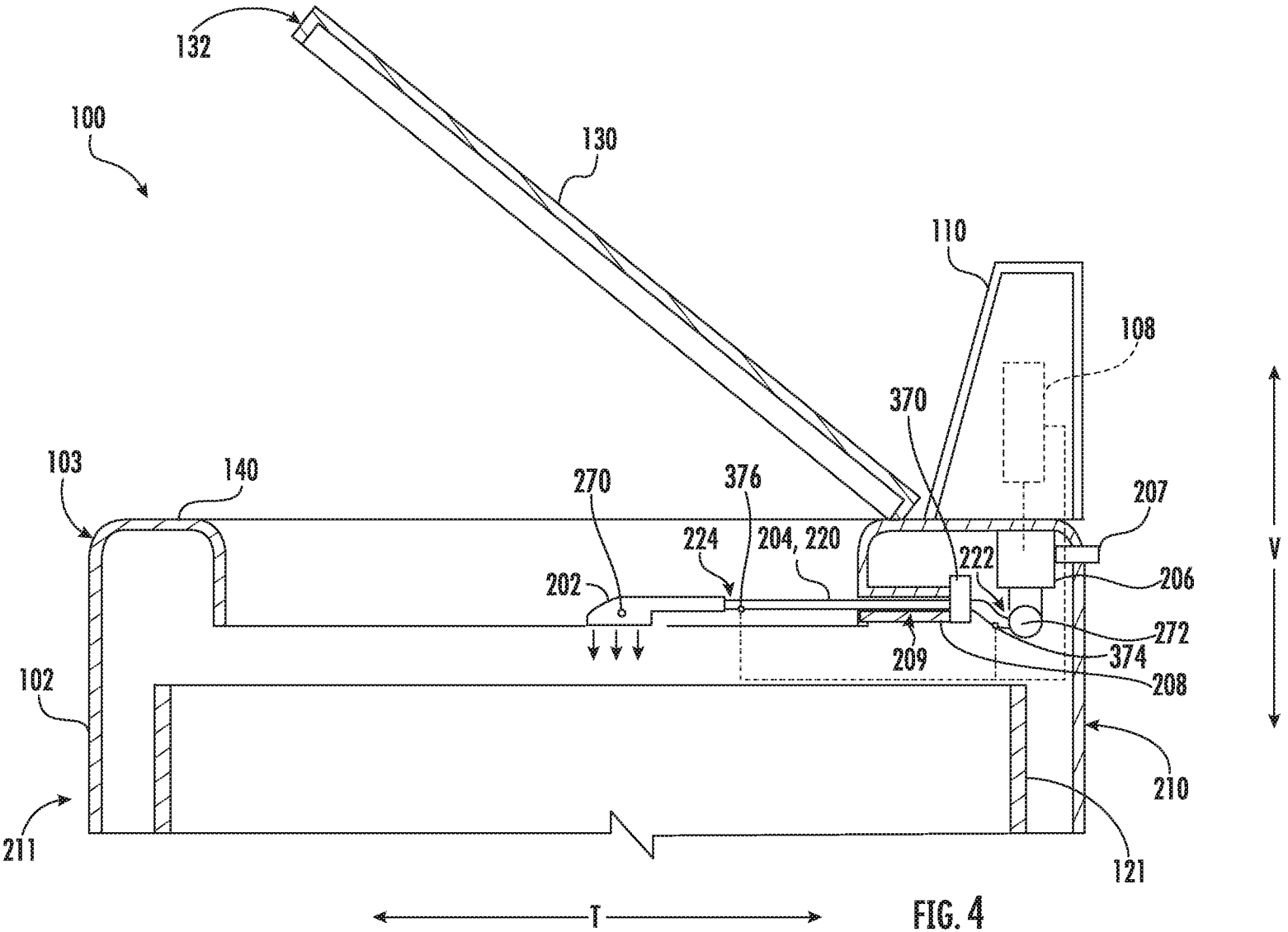
FIG. 4 provides a schematic side, cross-sectional view of the exemplary nozzle assembly of FIG. 3 shown in an extended position.
Figure 5:
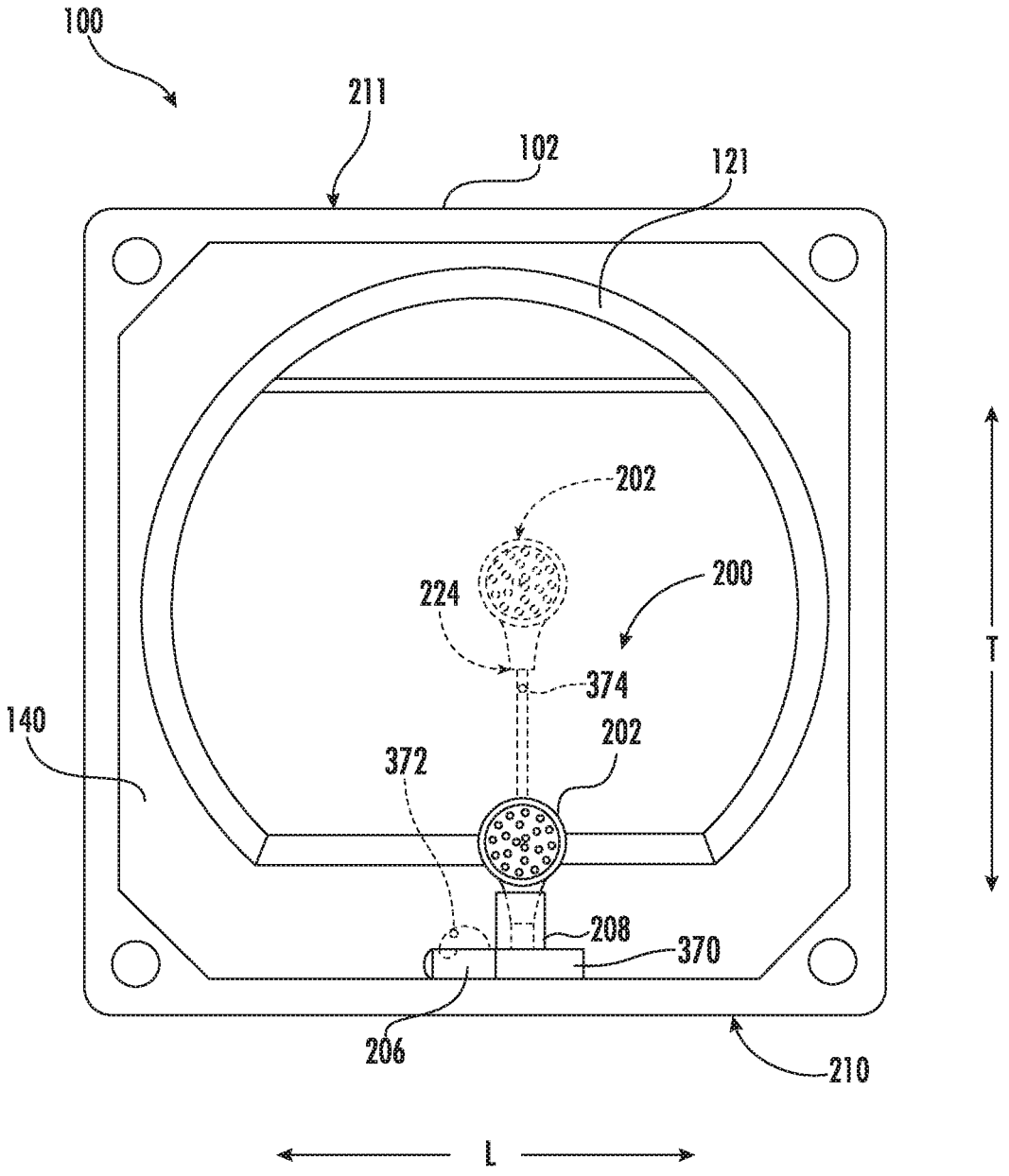
FIG. 5 provides a schematic view of the exemplary nozzle assembly of FIG. 3 shown in both the extended position (in phantom) and the retracted position.

Referring now specifically to FIGS. 3 through 5, retractable fluid supply conduit 204 includes a flexible hose 220 having a first end 222 fluidly coupled to valve assembly 206 and a second end 224 fluidly coupled to extendable nozzle 202. Flexible hose 220 may be any size sufficient to provide wash fluid at the desired flow rate and may be any length suitable for providing a user with flexibility in directing wash fluid to desired portions of wash tub 121 (or otherwise performing a pretreating operation for articles in or near wash tub 121). For example, flexible hose 220 may extend along the entire depth of washing machine appliance 100 along the transverse direction T. Alternatively, according to the illustrated embodiments, flexible hose 220 may only extend about half way into wash tub 121 within a vertical plane when in the extended position (see FIGS. 4 and 5). In this manner, the likelihood of extendable nozzle 202 spraying wash fluid outside of wash tub 121 is reduced. Optionally, one or more retraction mechanisms (not pictured), such as a weighted loop on (e.g., directly or indirectly on) flexible tube or a mechanical spring that extends from nozzle housing 208 to extendable nozzle 202, may be provided to urge or bias extendable nozzle 202 toward the retracted position (see FIG. 3).

Figure 6:
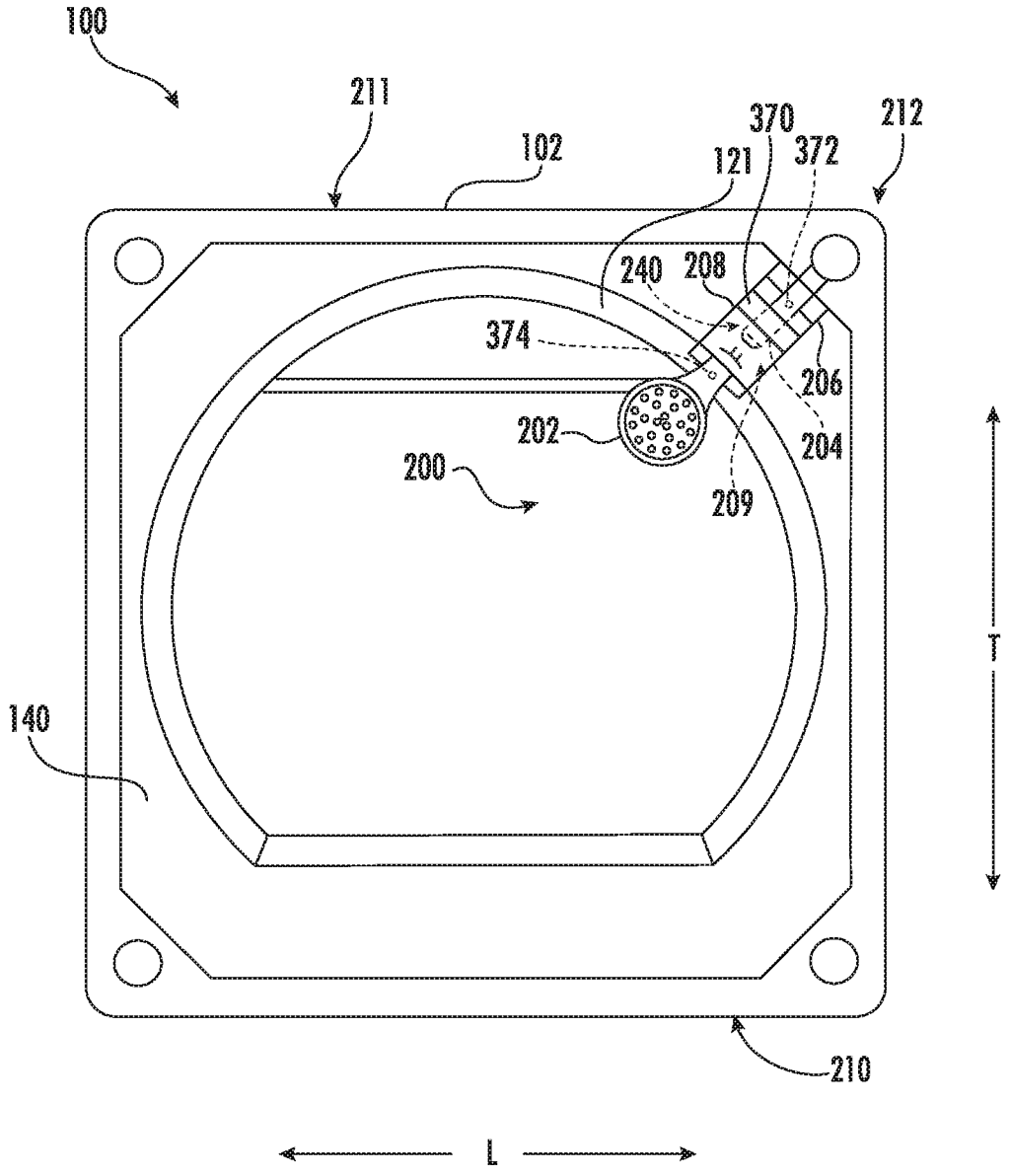
FIG. 6 provides a schematic view of a nozzle assembly of the exemplary washing machine appliance of FIG. 1 shown in a retracted position according to another exemplary embodiment of the present disclosure.
Figure 7:
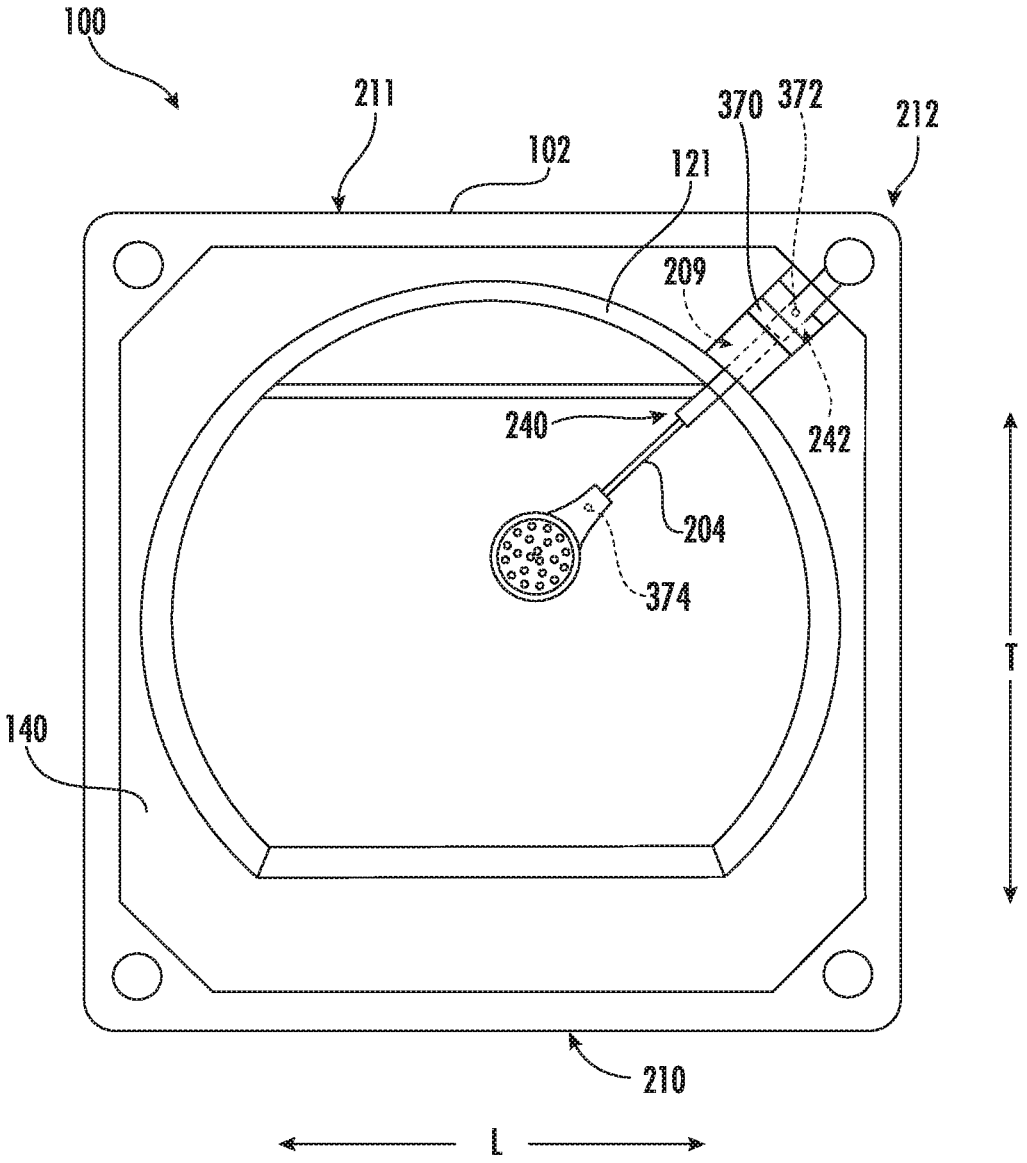
FIG. 7 provides a schematic view of the exemplary nozzle assembly of FIG. 6 shown in an extended position.

Referring now to FIGS. 6 and 7, according to an alternative embodiment of the present disclosure, retractable fluid supply conduit 204 is a telescoping arm 240. As illustrated, telescoping arm 240 includes two or more telescoping sections 242 that are concentric to each other and may slide relative to each other as extendable nozzle 202 is moved between the extended position (see FIG. 7) and the retracted position (see FIG. 6). According to the illustrated embodiment, telescoping sections 242 of telescoping arm 240 actually function as the fluid conduit for providing a flow of wash fluid to extendable nozzle 202. However, it should be appreciated that according to alternative embodiments, a flexible tube or conduit may be positioned within and supported by telescoping arm 240.

In some embodiments, telescoping sections 242 engage each other such that telescoping arm 240 and extendable nozzle 202 extends only in a single vertical plane above wash tub 121. In this manner, the risk of dropping extendable nozzle 202 into wash tub 121 may be reduced or eliminated. In addition, a user may move extendable nozzle 202 to the extended position and then be free to use two hands underneath extendable nozzle 202 (e.g., to, scrub, work, or otherwise clean an article of clothing). In order to further facilitate easy cleaning of articles of clothing, according to exemplary embodiments, extendable nozzle 202 may include one or more lights, such as light emitting diodes (LEDs), positioned on (e.g., directly or indirectly on) extendable nozzle 202 and configured for illuminating when extendable nozzle 202 is moved toward the extended position.

According to the illustrated embodiments of FIGS. 6 and 7, telescoping arm 240 includes three sections 242 and extends from a corner 212 of cabinet 102. In this manner, more space is provided to accommodate telescoping arm 240 and nozzle assembly 200 between wash tub 121 and cabinet 102. It should be appreciated that the size, position, number and size of sections 242, and general configuration of telescoping arm 240 may vary according to alternative embodiments. For example, telescoping arm 240 could extend from the back center of cabinet 102. Alternatively, retractable fluid supply conduit 204 could be a fixed length arm that is connected in back corner 212 of cabinet 102 and pivots (e.g., pivots 45 degrees between a first position where extendable nozzle 202 is positioned at a back center of cabinet 102 to a second position where extendable nozzle 202 is positioned over a center of wash tub 121) within a vertical plane. Moreover, other configurations are possible and within the scope of the present disclosure.

Referring again to FIGS. 3 and 4, a user may wish to add additional water to wash tub 121 or add a particular wash fluid for a pretreat operation. For example, a user may wish to prewash one or more articles of clothing or may perceive that more water is needed to effectively wash a load. In order to provide a user with control over the flow of wash fluid being dispensed through extendable nozzle 202, nozzle assembly 200 may further include one or more user input buttons 270 for adding a wash fluid to wash tub 121. User input buttons 270 may be operably coupled with controller 108 and/or valve assembly 206 for controlling the flow of wash fluid. According to the illustrated embodiment, user input button 270 is located on extendable nozzle 202 for easy access by an operator. However, according to alternative embodiments, user input button 270 may be positioned at any other suitable location or locations.

As shown in FIGS. 3 and 4, valve assembly 206 generally includes a plurality of valves 272 configured to supply, for example, hot water, cold water, warm water, a mixture of water and detergent, other wash additives, etc. According to exemplary embodiments, user input buttons 270 are configured for controlling one or more of the plurality of valves 272 that can be turned on/off independently or together in any combination. Valves 272 may be, for example, solenoid valves that are electrically connected to controller 108. However, any other suitable water valve may be used to control the flow of water or wash fluid. Controller 108 may selectively open and close water valves 272 to allow water or wash fluid to flow from hot water inlet, cold water inlet, detergent inlet, softener inlet, or any other suitable fluid through a respective valve seat. Valve assembly 206 or nozzle housing 208 may further include a one or more detergent storage compartments, mixing chambers, or other features within which a fluid additive (e.g., powdered or liquid detergent) can mix with hot or cold water prior to being dispensed out of the extendable nozzle 202.

User input button 270 may be any button or switch suitable for providing an indication to controller 108 that a particular action should be initiated. For example, buttons 270 may be push button switches, toggle switches, rocker switches, or any other suitable tactile switch, such as capacitive touch buttons. According to the illustrated embodiments, buttons 270 are momentary switches (sometimes referred to as mom-off-mom switches). In this regard, buttons 270 are biased switches that return to their unlatched or unpressed state when released (e.g., by spring force).

It should be appreciated that the amount of water or wash fluid added to wash tub 121 upon pressing buttons 270 may vary depending on the application or wash cycle. Similarly, the amount of water delivered may be preset such that pressing buttons 270 delivers the predetermined amount of water. Alternatively, valves 272 may be configured to remain open at all times when corresponding buttons 270 are depressed. In this manner, a user may precisely control the amount of water added to wash tub 121.

In some embodiments, a supplemental heater 370 is included within washing machine appliance 100 to selectively heat water or wash fluid therein. For example, supplemental heater 370 may be positioned in thermal communication with the flow of water or wash fluid to extendable nozzle 202 (e.g., downstream from valve assembly 206). Moreover, supplemental heater 370 may be in operable communication with (e.g., electrically connected to) controller 108. Generally, supplemental heater 370 may be or include any suitable heating element for selectively heating water or wash fluid within nozzle assembly 200. For instance, in exemplary embodiments, supplemental heater 370 includes a resistive heating element. Optionally, the resistive heating element of supplemental heater 370 may be positioned along the flow path of water or wash fluid between valve assembly 206 and nozzle outlet 314 (FIG. 8).

In certain embodiments, supplemental heater 370 is positioned on (e.g., in direct or indirect conductive thermal communication or contact with) retractable fluid supply conduit 204. In additional or alternative embodiments, supplemental heater 370 is positioned above tub 121, notably supplying heat proximal to nozzle outlet 314 (FIG. 8). As illustrated, supplemental heater 370 is upstream from extendable nozzle 202 (e.g., upstream from nozzle inlet 312—FIG. 8). Thus, when activated, supplemental may direct heat to (e.g., raise the temperature of) water or wash fluid flowing to (and subsequently from) extendable nozzle 202.

As shown, for example in FIGS. 3 and 4, one or more temperature sensors (e.g., a first temperature sensor 372 and a second temperature sensor 374) are included with nozzle assembly 200. Temperature sensor(s) 372, 374 may be provided as any suitable temperature-detecting element (e.g., thermistor, thermocouple, etc.). Moreover, temperature sensor(s) 372, 374 may be in operable communication with (e.g., electrically connected to) controller 108. Generally, temperature sensor(s) 372 and 374 are positioned in thermal communication with water or wash fluid within nozzle assembly 200. In particular, temperature sensor(s) 372, 374 is/are positioned within washing machine appliance 100 upstream from nozzle outlet 314 (FIG. 8). Thus, temperature sensor(s) 372, 374 may detect the temperature of water or wash fluid within nozzle assembly 200. Moreover, signals relating to the detected temperature may be communicated with controller 108.

In certain embodiments, a first temperature sensor 372 is positioned downstream from the valve assembly 206. First temperature sensor 372 may thus detect the temperature (e.g., directly or indirectly) of water or wash fluid downstream from valve assembly 206. Additionally or alternatively, first temperature sensor 372 may be positioned upstream from supplemental heater 370, such that first temperature sensor 372 can detect the temperature of water or wash fluid upstream from supplemental heater 370. For instance, first temperature sensor 372 may be positioned on or along fluid conduit 204. As an example, as shown in FIGS. 3 through 5, first temperature sensor 372 may be in attached engagement (e.g., direct or indirect contact) with flexible hose 220 (e.g., proximal to first end 222 and distal to second end 224). As another example, as shown in FIGS. 6 and 7, temperature sensor 372 may be in attached engagement (e.g., direct or indirect contact) with telescoping arm 240 (e.g., proximal to valve assembly 206 and distal to extendable nozzle 202).

In optional embodiments, a second temperature sensor 374 is positioned downstream from the valve assembly 206, as well as supplemental heater 370, while remaining upstream from nozzle outlet 314 (FIG. 8). Second temperature sensor 374 may thus detect the temperature (e.g., directly or indirectly) of water or wash fluid downstream from supplemental heater 370 (e.g., before such water or wash fluid is flowed to tub 121). For instance, second temperature sensor 374 may be positioned on or along fluid conduit 204. As an example, as shown in FIGS. 3 through 5, temperature sensor 374 may be in attached engagement (e.g., direct or indirect contact) with flexible hose 220 (e.g., proximal to second end 224 and distal to first end 222). As another example, as shown in FIGS. 6 and 7, temperature sensor 374 may be in attached engagement (e.g., direct or indirect contact) with telescoping arm 240 (e.g., proximal to extendable nozzle 202 and distal to valve assembly 206).

Figure 9:
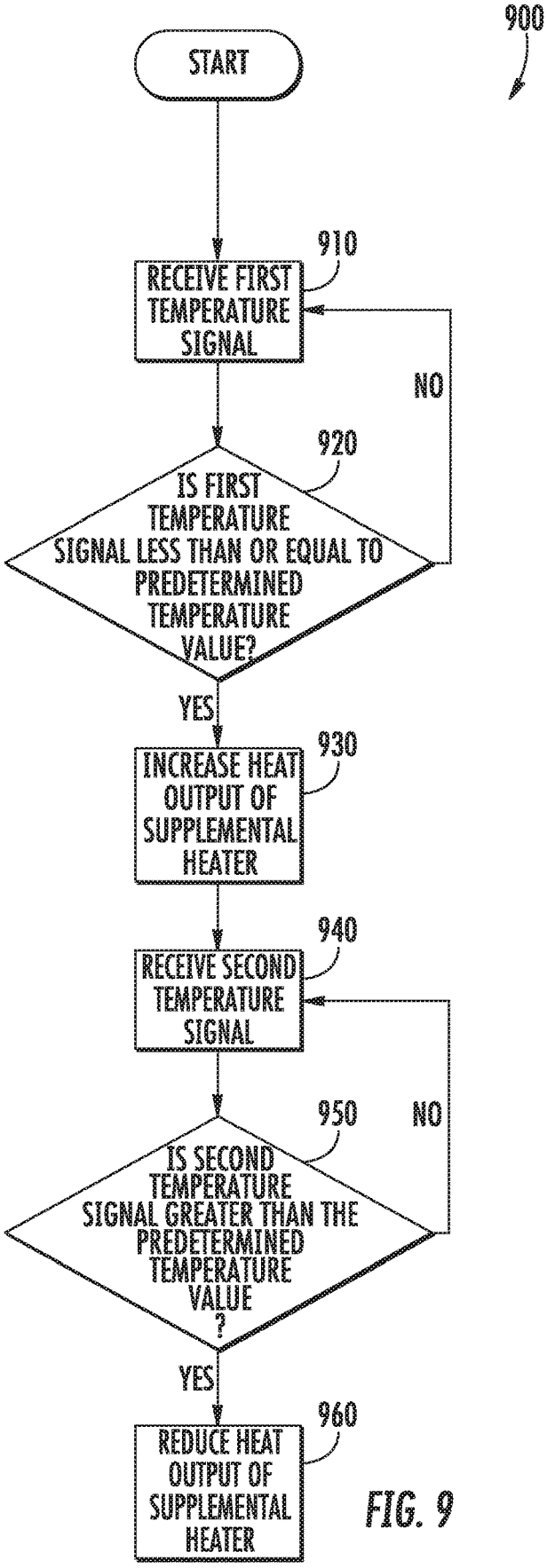
FIG. 9 provides a flow chart illustrating a method of operating a washing machine appliance according to exemplary embodiments of the present disclosure.

Referring now to FIG. 9, a flow chart illustrating exemplary methods that may be provided for use with washing machine appliances (e.g., washing machine appliance 100—FIG. 2) in accordance with the present disclosure. In general, the various steps of methods as disclosed herein may, in exemplary embodiments, be performed by the controller 108 as part of a flow operation that the controller 108 is configured to direct or initiate. During such methods, controller 108 may receive inputs and transmit outputs from various other components of the washing machine appliance 100. For example, controller 108 may send signals to and receive signals from control panel 110, display 114, nozzle assembly 200, valve assembly 206, and supplemental heater 370, as well as one or more temperature sensors 372, 374. Such methods advantageously facilitate improved temperature control for water or wash fluid discharged from nozzle assembly 200. Moreover, the dispensing of cold water slugs within nozzle assembly 200 may be mitigated or prevented.

At 910, the method 900 includes receiving a first temperature signal from the first temperature sensor. As noted above, the first temperature sensor may be positioned along the flow path of water or wash fluid between the nozzle assembly and the supplemental heater. Thus, the signal received at 910 may correspond to or otherwise indicate the temperature of water or wash fluid downstream from the nozzle assembly and upstream from the supplemental heater.

Prior or subsequent to 910, the method 900 may include directing a flow of water or wash fluid from valve assembly. The flow may be generally directed at a targeted temperature (i.e., a desired or suitable temperature for water or wash fluid flowing from the extendable nozzle). Thus, the method 900 may include controlling or directing valve assembly to flow water (e.g., a volume of water) from the cold water source or hot water source, depending on the target temperature.

At 920, the method 900 includes comparing the first temperature signal to a predetermined temperature value. Generally, the predetermined temperature value may correspond to a minimum suitable temperature based on the desired water or wash flow temperature from the extendable nozzle. For example, the predetermined temperature value may be equal to the target temperature. Thus, the predetermined temperature value may be selected according to one or more user inputs. Moreover, the predetermined temperature value may correspond to the temperature below which a cold water slug may be considered present.

If the first temperature signal indicates a temperature value that is greater than the predetermined temperature value, the method 900 may repeat or continue receiving temperature signals from the first temperature sensor, as at 910. Optionally, the supplemental heater may maintained in an inactive or deactivated state such that no heat is generated at the supplemental heater when the first temperature signal is greater than the predetermined temperature value.

In optional embodiments, 920 further includes initiating a visual signal (e.g., at the electronic indicator display) in response to the first temperature signal being greater than the predetermined temperature value. A separate or unique visual signal may be initiated (e.g., at the electronic indicator display) in response to the first temperature signal being less than or equal to the predetermined temperature value.

If the first temperature signal indicates a temperature value that is less than or equal to the predetermined temperature value, the method 900 may proceed to 930.

At 930, the method 900 includes increasing heat output of the supplemental heater. For instance, 930 may include activating the supplemental heater in response to the first temperature signal being less than or equal to the predetermined temperature value. Activation of the supplemental heater will generally cause heat or thermal energy to be generated and output by the supplemental heater. That output heat will be received, at least in part, by water or wash fluid within the nozzle assembly (e.g., upstream from the extendable nozzle).

At 940, the method 900 includes receiving a second temperature signal from the first temperature sensor (e.g., subsequent to receiving the first temperature signal at 910). The received second temperature signal may thus provide an indication of the change in water or wash fluid temperature from the valve assembly over a set period of time.

At 950, the method 900 includes comparing the second temperature signal to the predetermined temperature value. If the second temperature signal indicates a temperature value that is less than or equal to the predetermined temperature value, the method 900 may repeat or continue receiving temperature signals from the first temperature sensor, as at 940. The supplemental heater may remain active, directing heat to the water or wash fluid within nozzle assembly. Moreover, new temperature signals may be continuously received (e.g., from the first temperature sensor). If the water or wash fluid within the nozzle assembly is never determined to exceed the predetermined temperature value, the supplemental heater may remain active for the entire flow operation (e.g., until a user ends the flow operation entirely). In optional embodiments, 950 further includes initiating or continuing the visual signal (e.g., at the electronic indicator display), thus indicating that the temperature value is less than or equal to the predetermined temperature value. If the first temperature signal indicates a temperature value that is greater than the predetermined temperature value, the method 900 may proceed to 960.

At 960, the method 900 includes reducing a heat output of the supplemental heater in response to the second temperature signal being greater than the predetermined temperature value. For instance, the supplemental heater may be deactivated such that no further heat is generated from the supplemental heater. Alternatively, the supplemental heater may be placed in a reduced heat output setting, thereby lowering the amount of heat generated and directed to water or wash fluid within the nozzle assembly.

Optionally, one or more supplementary temperature signals may be received from the second temperature sensor (e.g., simultaneously or subsequently to 940). Such supplementary temperature signals may be similarly compared to a temperature value (e.g., the predetermined temperature value). If it is determined that a supplementary temperature signal is greater than, for example, the predetermined temperature value, the method 900 may include reducing the heat output of the supplemental heater, regardless of the comparison at 950.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a cabinet;
- a tub positioned within the cabinet;
- a wash basket rotatably mounted within the tub, the wash basket defining a wash chamber for receiving articles for washing; and
- a nozzle assembly mounted within the cabinet and configured to provide wash fluid to the tub, the nozzle assembly comprising
  - an extendable nozzle movable between a retracted position and an extended position, the extendable nozzle defining a fluid path extending in fluid communication between a nozzle inlet and a nozzle outlet,
  - a valve assembly configured to provide a flow of wash fluid to the extendable nozzle,
  - a retractable fluid supply conduit extending in fluid communication between the valve assembly and the nozzle inlet of the extendable nozzle to direct the flow of wash fluid to the extendable nozzle,
  - a supplemental heater positioned in thermal communication with the flow of wash fluid between the valve assembly and the nozzle outlet, and
  - a temperature sensor positioned in thermal communication with the flow of wash fluid downstream from the valve assembly to detect a temperature of the flow of wash fluid to the extendable nozzle.

2. The washing machine appliance of claim 1, wherein the supplemental heater comprises a resistive heating element positioned upstream from the nozzle outlet.

3. The washing machine appliance of claim 1, wherein the supplemental heater is positioned on the retractable fluid supply conduit upstream from the nozzle inlet.

4. The washing machine appliance of claim 1, wherein the supplemental heater is positioned above the tub.

5. The washing machine appliance of claim 1, further comprising a controller in operable communication with the temperature sensor and the supplemental heater, the controller configured to initiate a flow operation comprising:
- receiving a temperature signal from the temperature sensor,
- comparing the temperature signal to a predetermined temperature value, and
- activating the supplemental heater in response to the temperature signal being less than or equal to the predetermined temperature value.

6. The washing machine appliance of claim 5, further comprising an electronic indicator display mounted to the cabinet in operable communication with the controller, wherein the flow operation further comprises
- initiating a visual signal at the electronic indicator display in response to the temperature signal being greater than the predetermined temperature value.

7. The washing machine appliance of claim 5, further comprising a user interface mounted to the cabinet in operable communication with the controller, wherein the predetermined temperature value is based on a user-input signal received from the user interface.

8. The washing machine appliance of claim 1, wherein the temperature sensor is a first temperature sensor, and wherein the nozzle assembly further comprises a second temperature sensor positioned downstream from the supplemental heater.

9. The washing machine appliance of claim 8, further comprising a controller in operable communication with the first temperature sensor, the second temperature sensor, and the supplemental heater, the controller configured to initiate a flow operation comprising:

receiving a first temperature signal from the first temperature sensor, comparing the first temperature signal to a predetermined temperature value, activating the supplemental heater in response to the first temperature signal being less than or equal to the predetermined temperature value, receiving a second temperature signal from the first temperature sensor, comparing the second temperature signal to the predetermined temperature value, and reducing a heat output of the supplemental heater in response to the second temperature signal being greater than the predetermined temperature value.

10. A washing machine appliance comprising:

a cabinet;

a tub positioned within the cabinet;

a wash basket rotatably mounted within the tub, the wash basket defining a wash chamber for receiving articles for washing; and a nozzle assembly mounted within the cabinet and configured to provide wash fluid to the tub, the nozzle assembly comprising an extendable nozzle movable between a retracted position and an extended position, the extendable nozzle defining a fluid path extending in fluid communication between a nozzle inlet and a nozzle outlet, a valve assembly configured to provide a flow of wash fluid to the extendable nozzle, a retractable fluid supply conduit extending in fluid communication between the valve assembly and the nozzle inlet of the extendable nozzle to direct the flow of wash fluid to the extendable nozzle, a supplemental heater positioned in thermal communication with the flow of wash fluid between the valve assembly and the nozzle outlet, and a temperature sensor positioned in thermal communication with the flow of wash fluid between the valve assembly and the supplemental heater to detect a temperature of the flow of wash fluid to the extendable nozzle.

11. The washing machine appliance of claim 10, wherein the supplemental heater comprises a resistive heating element positioned upstream from the nozzle outlet.

12. The washing machine appliance of claim 10, wherein the supplemental heater is positioned on the retractable fluid supply conduit upstream from the nozzle inlet.

13. The washing machine appliance of claim 10, wherein the supplemental heater is positioned above the tub.

14. The washing machine appliance of claim 10, further comprising a controller in operable communication with the temperature sensor and the supplemental heater, the controller configured to initiate a flow operation comprising:

receiving a temperature signal from the temperature sensor, comparing the temperature signal to a predetermined temperature value, and activating the supplemental heater in response to the temperature signal being less than or equal to the predetermined temperature value.

15. The washing machine appliance of claim 14, further comprising an electronic indicator display mounted to the cabinet in operable communication with the controller, wherein the flow operation further comprises initiating a visual signal at the electronic indicator display in response to the temperature signal being greater than the predetermined temperature value.

16. The washing machine appliance of claim 14, further comprising a user interface mounted to the cabinet in operable communication with the controller, wherein the predetermined temperature value is based on a user-input signal received from the user interface.

17. The washing machine appliance of claim 10, wherein the temperature sensor is a first temperature sensor, and wherein the nozzle assembly further comprises a second temperature sensor positioned downstream from the supplemental heater.

18. The washing machine appliance of claim 17, further comprising a controller in operable communication with the first temperature sensor, the second temperature sensor, and the supplemental heater, the controller configured to initiate a flow operation comprising:

receiving a first temperature signal from the first temperature sensor, comparing the first temperature signal to a predetermined temperature value, activating the supplemental heater in response to the first temperature signal being less than or equal to the predetermined temperature value, receiving a second temperature signal from the first temperature sensor, comparing the second temperature signal to the predetermined temperature value, and reducing a heat output of the supplemental heater in response to the second temperature signal being greater than the predetermined temperature value.

* * * * *